United States Patent [19]

Lane et al.

[11] 4,197,656

[45] Apr. 15, 1980

[54] CHALK LINE DISPENSER

[75] Inventors: Derek Lane, Santa Rosa, Calif.; Thomas G. Farr, 2982 Harris St., Eureka, Calif. 95501; Stuart L. Galles, 578 Meadowlark, Livermore, Calif. 94550

[73] Assignees: Thomas Farr; Stuart Galles; by said Derek Lane

[21] Appl. No.: 946,108

[22] Filed: Sep. 27, 1978

[51] Int. Cl.[2] ..... B44D 3/38

[52] U.S. Cl. ..... 33/414

[58] Field of Search ..... 33/87, 138–140, 33/126.4, 126.5, 126.6, 413, 414; 242/96, 84.8; 15/210 B

[56] References Cited

U.S. PATENT DOCUMENTS

| | | | |
|---|---|---|---|
| 627,057 | 6/1899 | Gavin | 33/87 |
| 2,439,171 | 4/1948 | Kreider | 15/210 B |
| 2,504,563 | 4/1950 | Menke | 242/84.8 |
| 2,589,500 | 3/1952 | Landon et al. | 242/84.8 X |
| 3,205,525 | 9/1965 | Birtzer | 15/210 B |

*Primary Examiner*—Harry N. Haroian
*Attorney, Agent, or Firm*—Melvin R. Stidham

[57] ABSTRACT

A chalk line dispenser comprising a drive casing and a replacable reel casing, which are joined to form a complete assembly. The drive casing includes a shaft and a coil spring-powered drive therefor, with a thumb-operated lever for releasing a clutch to enable spring reeling of the line. The shaft extends from the drive casing in square cross-section and is engaged by a complementary opening in the reel. The reel casing carries the reel and powdered chalk, and includes a ledge over which the chalkline passes when being reeled into the casing. A squeegee carried on the thumb operator of the clutch release presses the chalkline against the ledge to squeeze any moisture from it, causing same to drop into a moisture sump carried below the ledge. A desiccant may be carried in the moisture sump and/or may be mixed with the powdered chalk itself.

7 Claims, 6 Drawing Figures

CHALK LINE DISPENSER

BACKGROUND OF THE INVENTION

In conventional chalkline operation, a chalkline is unreeled from a spool and extended between two established points to impress a straight chalkline on the foundation or other horizontal surface. Then, the chalkline is reeled in, dragging it over the floor, and occasionally, through any standing water or damp surfaces which may be present. Such moisture picked up by the chalkline, tends to congeal the chalk and often clogs up the dispenser itself when the chalkline is subsequently pulled from the reel.

OBJECTS OF THE INVENTION

It is an object of this invention to provide a chalk reel wherein moisture may be effectively removed from the chalk line when it is reeled in.

It is a further object of this invention to provide a chalk reel with means for isolating moisture in the chalkline casing from the chalk and line.

It is a further object of this invention to provide a chalk reel with self-contained powdered chalk and means to facilitate chalking the line.

It is a further object of this invention to provide a chalkline reel wherein the reel and chalk supply is readily removed from a separate drive unit for replacement thereof as required.

Other objects and advantages of this invention will become apparent from the description to follow, particularly when read in conjunction with the accompanying drawings.

SUMMARY OF THE INVENTION

In carrying our this invention, there is provided a housing which is made up of two separable casings, a drive casing and a reel casing. The drive casing includes an input shaft which is rotated by a tightened coil spring to drive, through a gear train, an output shaft which has a square or splined extension which is received in a complementary socket on the reel. The coil spring is tightened by a cocking or winding wheel, with a one-way clutch enabling unidirectional rotation of the winding wheel, but preventing return when it is released. A second one-way clutch is interposed in the drive shaft to prevent rotation thereof by the coil springpowered drive. Hence, the output shaft is effectively locked to enable the spring to tighten. However, the second clutch will enable rotation in the opposite direction so that the spring can also be tightened from its inner diameter by turning the shaft, as by pulling the chalkline in opposition to the wheel. Then, when the clutch release is depressed the output shaft is released to reel in the chalkline and a squeegee carried on the thumb actuator squeezes the line against a ledge to force moisture from the chalkline, allowing it to drop into a moisture sump below the ledge. Powdered chalk is carried in the reel casing and vanes on the reel stir up the chalk as the line is reeled in. Open sides of the reel allow the chalk to penetrate the line as it is reeled in. A desiccant may be carried in the moisture sump to keep the interior of the casing dry. The reel with chalkline and powdered chalk may be carried in the reel casing as a separate unit attachable to the drive casing, with the reel coupled to the square shaft.

DESCRIPTION OF A PREFERRED EMBODIMENT

Figure 1:
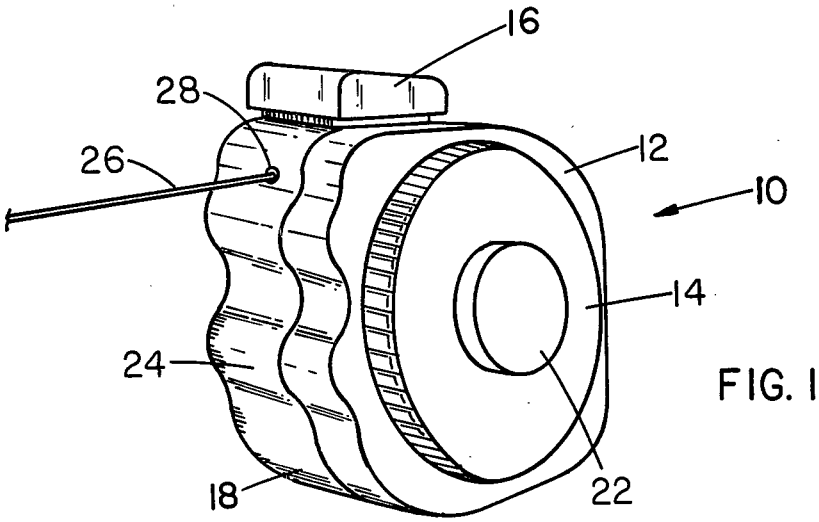
FIG. 1 is a view in perspective showing the exterior of the chalk line reel of this invention.
Figure 2:
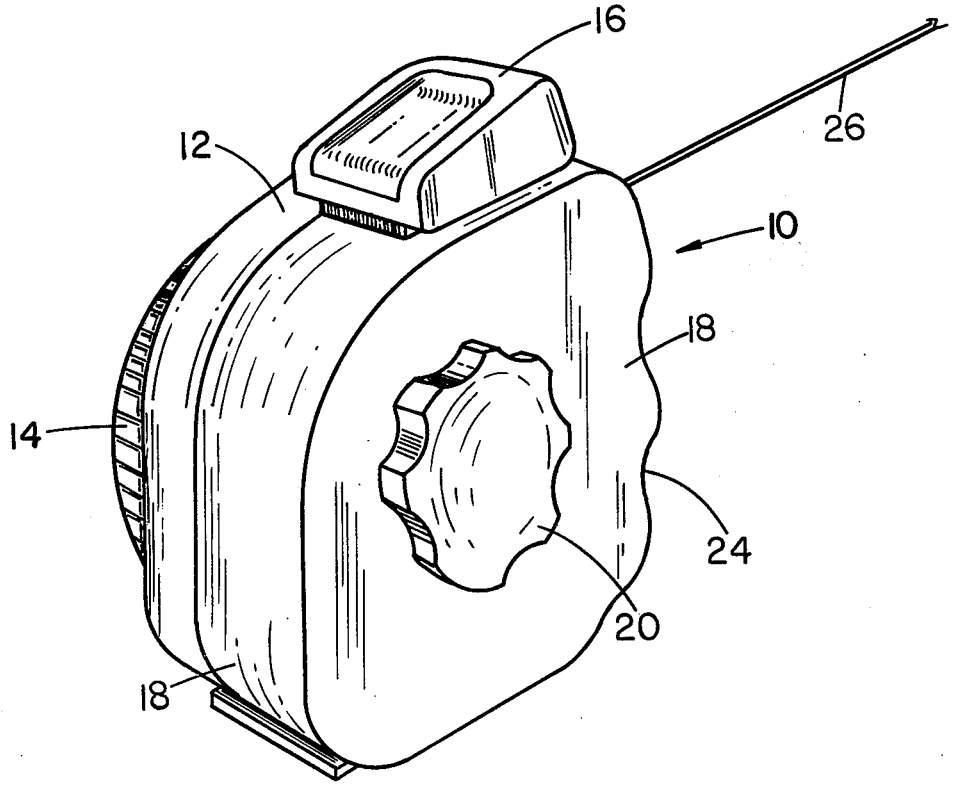
FIG. 2 is a view in perspective of the chalk line reel viewed from the other side.
Figure 4:
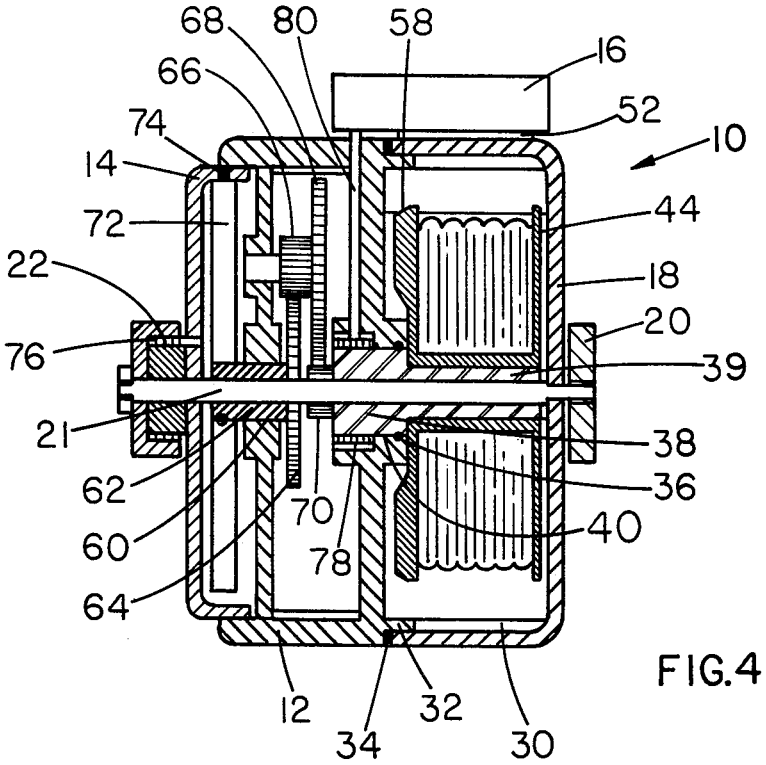
FIG. 4 is a transverse section view taken along line 4—4 of FIG. 3.

Referring now to FIGS. 1 and 2 with greater particularity, the chalkline reel 10 of this invention includes a drive casing 12 with a winding or cocking wheel 14 and a thumb-actuated clutch release 16. The button or trigger 16 overlies the complementary reel casing 18, which is interlocked with the drive casing 12 in a manner hereinafter to be described. The assembly is secured by a locknut 20 threaded onto a tie rod 21 extending through the complete assembly 10 from a one-way clutch unit 22 (FIG. 4). Aligned finger indentations 24 are provided in the drive casing and reel casing to help the operator resist torque as the chalkline 26 is drawn back through a grommet or port 28 in the reel casing 18 of the dispenser 10. The drive and reel casings 12 and 18 may be made of any suitable plastic and the grommet 28 may be made of a metal such as brass, to minimize friction wear.

Figure 3:
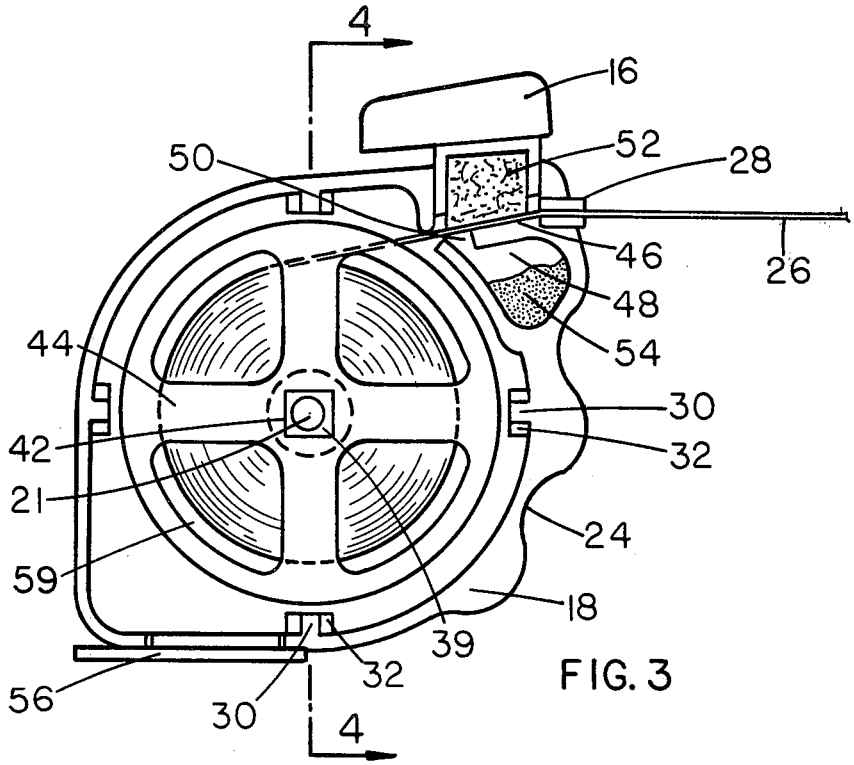
FIG. 3 is a longitudinal section view taken through the chalkline reel.
Figure 5:
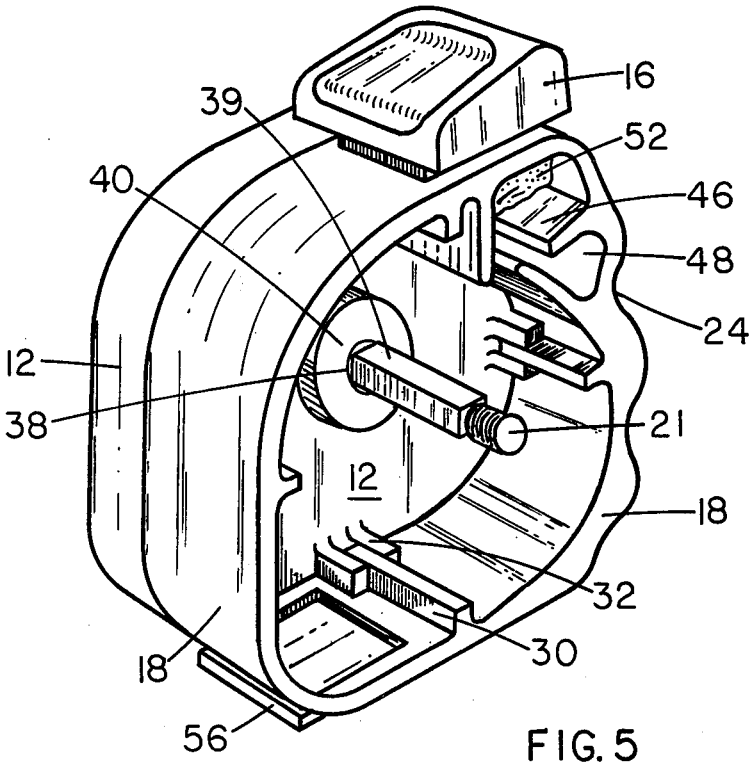
FIG. 5 is a view in perspective of the device with the reel casing removed.

Referring now more particularly to FIGS. 3, 4 and 5, when the drive and reel casings 12 and 18 are secured together a series of ribs 30 on the reel casing 18 are received between paris of interlock members 32 on the drive casing 12, whereby the casings 12 and 18 are locked against relative rotation. A suitable seal or gasket 34 is provided to keep the reel casing 18 water-tight when secured by the lock nut 20, and another seal 36 is provided around the drive shaft 38.

The drive shaft 38 is rotatable on the tie rod 21 and journalled at 40 in the drive casing 12, to extend outward thereof, with a square or splined extension 39 disposed to receive a complementary socket 42 in the chalk line spool or reel 44. Hence, when the shaft 38 is rotated by spring means, hereinafter to be described, it drives the reel to pull in the chalk line 26 through the grommet 28.

Carried in the reel casing 18 inward of the grommet 28 is a ledge 46 over which the chalk line 26 slides as it is being wound onto the reel 44. A small chamber or moisture sump 48 is formed below the ledge with access thereto through a small opening 50. A squeegee 52 of a foamed plastic or the like, is carried on the thumb lever 16 directly over the ledge 46 so that when the thumb lever is depressed to release the clutch, as will be described, the squeegee engages the chalk line to squeeze moisture out of it and drop it into the moisture sump 48. If desired, a quantity of a suitable moisture absorbing material 54 may be provided in the sump 48 to absorb moisture which may drop therein. In addition, or in the alternative, a quantity of desiccant may be mixed with the powdered chalk carried within the reel casing 18 to absorb the moisture in the chalk line 24. As such particles of absorbed moisture, they will become heavier and drop to the bottom of the casing 18 where they may be removed at the trap door 56. The trap door 56 may also be used as a fill opening for adding chalk to the reel casing 18. The powdered chalk may be agitated by fins or paddles 58 extending from a side of the reel 44. Hence, as the reel is turned the chalk is stirred. In addition, with the opening 59 in the sides of the reel 44 penetration of the chalk to coat the line 26 is greatly facilitated.

In the event that the chalk becomes unduly moist, the entire reel casing with self-contained chalk supply may be removed and replaced with a new one which is slipped over the square shaft 39 with the ribs 36 on the drive casing. Then, the locknut 20 is threaded onto the tie rod 21 to secure the assembly 10.

Figure 6:
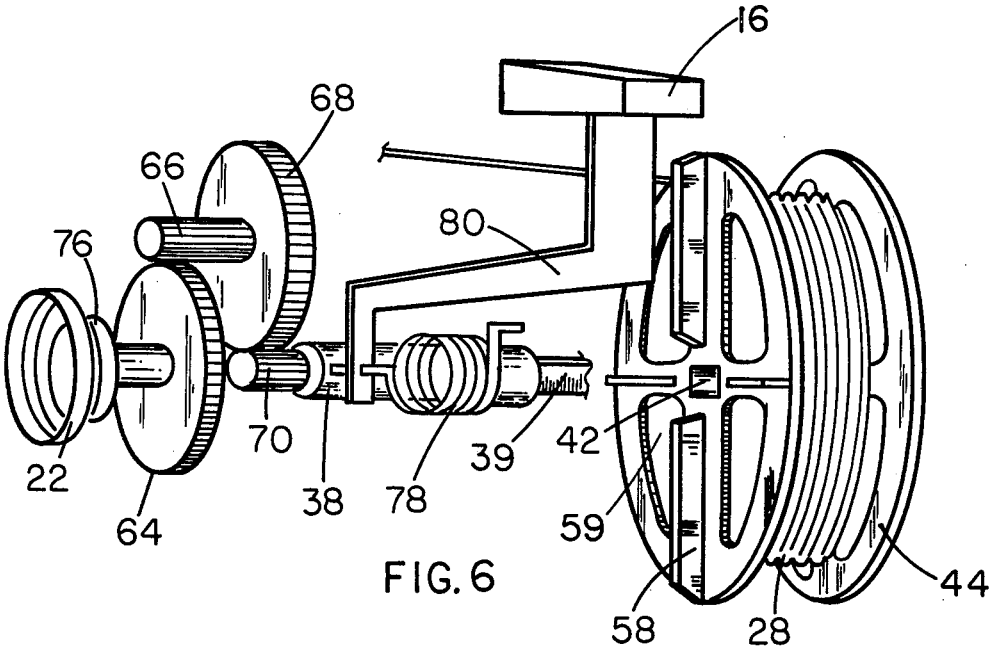
FIG. 6 is a view in perspective showing the chalk line drive mechanism.

Referring now particularly to FIGS. 4 and 6, the drive mechanism of this chalk line reel 10 will now be described. Rotatably carried on the tie rod 21, and journalled at 60 in the outer wall of the drive casing 12 is an input shaft 62 on which is carried a pinion 64, which through a suitable gear train 66, 68 and 70 drives the output shaft 38 at a desired rate and in the direction opposite to that of input shaft 62. A coil spring 72 which is secured at 74 to the winding wheel 14 and at its other end to the input shaft 62 constitutes the power source. Interposed between the winding wheel 14 and the stationary clutchhousing 22 is a one way clutch 76 which enables rotation of the winding wheel 14 in a spring-tightening direction but which prevents rotation in the opposite direction. Hence, the wheel may be turned through a partial rotation, released and then regripped and turned through another increment, without rotating free in the operator's hand.

Interposed between the inner wall of the drive casing 12 and the shaft 38 is a second one-way clutch 78 which prevents rotation of the shaft in a counter-clockwise direction in FIG. 3 and enables movement only in a clockwise direction to unwind chalkline 26. Hence, the shaft 38 is locked against rotation by the spring until released, but is free to rotate by pulling on the chalkline 26. Accordingly, the spring 72 may be tightened from its outer diameter by turning the cocking wheel 14, or from its inner diameter by turning the shaft 38 through pulling the chalkline 26. Movably mounted in the drive casing 12 is the clutch release lever 80 which is actuated by the thumb actuator 16 to release the second one-way clutch 78 and, at the same time, to squeeze the returning chalkline 24 as previously described. The spring bias of the clutch 78 retracts the squeegee 52 from the ledge 46 when the thumb actuator 16 is released.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A chalk line dispenser comprising:

a housing including separable drive casing and reel casing;

a drive shaft rotatably mounted in said housing;

spring means in said drive casing operative to drive said shaft;

a reel in said reel casing received on said shaft for rotation therewith by said spring means to wind a chalk line thereon;

interlock means on said casings to prevent relative rotation thereof;

an opening in said reel casing to closely accommodate a chalk line therethrough;

a ledge in said reel casing over which an incoming chalk line passes from said opening;

s squeegee member in said housing above said ledge and manually moveable therein toward said ledge; and a moisture sump in said reel casing below said ledge.

2. The chalk line dispenser defined by claim 1 including;

space in said reel casing for accommodating powdered chalk.

3. The chalk line dispenser defined by claim 1 including:

a moisture absorbent material in said moisture sump.

4. The chalk line dispenser defined by claim 2 including:

fins on said reel for agitating powdered chalk during rotation thereof.

5. The chalk line dispenser defined by claim 1 including:

complementary slidably engagable means on said drive shaft and said reel enabling said reel to be slipped on said drive shaft to be driven thereby.

6. The chalk line dispenser defined by claim 1 including:

an output one-way clutch in said drive shaft to prevent rotation of said drive shaft under power of said spring means; and a clutch release member operative when depressed to release said one-way clutch;

said squeegee member being carried on said clutch release member.

7. The chalk line dispenser defined by claim 5 including:

an input shaft;

a cocking wheel rotatable on said drive casing;

said spring means comprising a coil spring secured between said cocking wheel and said input shaft;

an input one-way clutch in said cocking wheel enabling undirectional rotation of said cocking wheel to tighten said coil spring.

* * * * *